US011172295B2

(12) United States Patent
Ninomiya et al.

(10) Patent No.: US 11,172,295 B2
(45) Date of Patent: Nov. 9, 2021

(54) INFORMATION PROCESSING DEVICE, INFORMATION PROCESSING SYSTEM, AND INFORMATION PROCESSING METHOD

(71) Applicant: YAMAHA CORPORATION, Hamamatsu (JP)

(72) Inventors: Tomoko Ninomiya, Hamamatsu (JP); Kazuya Mushikabe, Hamamatsu (JP); Akihiko Suyama, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

(21) Appl. No.: 16/719,025

(22) Filed: Dec. 18, 2019

(65) Prior Publication Data

US 2020/0128326 A1 Apr. 23, 2020

Related U.S. Application Data

(63) Continuation of application No. PCT/JP2017/022800, filed on Jun. 21, 2017.

(51) Int. Cl.
*H04R 3/12* (2006.01)
*H04R 5/02* (2006.01)
(Continued)

(52) U.S. Cl.
CPC ..... *H04R 3/12* (2013.01); *H04R 5/02* (2013.01); *H04R 5/04* (2013.01); *H04S 3/008* (2013.01); *H04S 2400/01* (2013.01)

(58) Field of Classification Search
None
See application file for complete search history.

(56) References Cited

U.S. PATENT DOCUMENTS 7,428,310 B2 * 9/2008 Park ..... H04S 7/301 381/104
8,605,921 B2 12/2013 Hesdahl
(Continued)

FOREIGN PATENT DOCUMENTS

CN 104967953 A 10/2015
CN 105163241 A 12/2015
(Continued)

OTHER PUBLICATIONS

International Search Report issued in Intl. Appln. No PCT/JP2017/022800 dated Sep. 5, 2017. English translation provided.
(Continued)

*Primary Examiner* — Paul W Huber
(74) *Attorney, Agent, or Firm* — Rossi, Kimms & McDowell LLP

(57) ABSTRACT

An information processing device includes an outputter, a receiver, a storage, and a position specifying processor. The outputter outputs a detection signal to the plurality of acoustic apparatuses. The receiver receives a disposed position of each of the plurality of acoustic apparatuses, based on a response signal outputted from the plurality of acoustic apparatuses. The storage stores disposition data indicating disposed positions of the plurality of acoustic apparatuses. The position specifying processor allocates the disposed position received by the receiver to any one of the plurality of acoustic apparatuses included in the disposition data, and causes the storage to store the disposed position allocated to the disposition data.

12 Claims, 11 Drawing Sheets

(51) Int. Cl.
*H04R 5/04* (2006.01)
*H04S 3/00* (2006.01)

(56) References Cited

U.S. PATENT DOCUMENTS

| | | | | |
|---|---|---|---|---|
| 9,124,966 | B2 * | 9/2015 | Kim | H04R 5/00 |
| 9,426,598 | B2 * | 8/2016 | Walsh | H04S 7/301 |
| 9,794,720 | B1 * | 10/2017 | Kadri | H04S 7/301 |
| 2004/0151476 | A1 | 8/2004 | Suzuki | |
| 2012/0113224 | A1 | 5/2012 | Nguyen | |
| 2015/0098596 | A1 | 4/2015 | Noah | |
| 2015/0163616 | A1 * | 6/2015 | Chatterjee | H04R 5/02 381/303 |
| 2016/0073197 | A1 * | 3/2016 | Hammer | H04R 5/02 381/80 |
| 2016/0309258 | A1 * | 10/2016 | Hiscock | H04R 5/04 |
| 2016/0309277 | A1 * | 10/2016 | Hiscock | H04S 7/302 |
| 2017/0055097 | A1 | 2/2017 | Dougherty | |
| 2017/0188151 | A1 * | 6/2017 | Veeramani | H04S 7/301 |
| 2018/0367893 | A1 * | 12/2018 | Lin | H04S 3/008 |

FOREIGN PATENT DOCUMENTS

| | | | |
|---|---|---|---|
| CN | 106488363 | A | 3/2017 |
| CN | 106797525 | A | 5/2017 |
| EP | 3024253 | A1 | 5/2016 |
| EP | 3416410 | A1 | 12/2018 |
| JP | 2004241820 | A | 8/2004 |
| JP | 2005523611 | A | 8/2005 |
| JP | 2007214897 | A | 8/2007 |
| JP | 2016502344 | A | 1/2016 |
| KR | 1020160144919 | A | 12/2016 |
| WO | 2008126161 | A1 | 10/2008 |
| WO | 2014085007 | A1 | 6/2014 |
| WO | 2016053037 | A1 | 4/2016 |
| WO | 2016165863 | A1 | 10/2016 |

OTHER PUBLICATIONS

Written Opinion issued in Intl. Appln. No. PCT/JP2017/022800 dated Sep. 5, 2017.

Office Action issued in Japanese Appln. No. 2019-524765 dated Apr. 6, 2021. English machine translation provided.

Office Action issued in Chinese Application No. 201780092382.7 dated Oct. 26, 2020 English translation provided.

Extended European Search Report issued in European Appln. No. 17914636.0 dated Jan. 13, 2021.

Office Action issued in Chinese Appln. No. 201780092382.7 dated Jun. 10, 2021. English machine translation provided.

* cited by examiner

FIG. 5

| ACOUSTIC APPARATUS | IP ADDRESS | MAC ADDRESS | SPACE | DISPOSITION PLACE | CHANNEL |
|---|---|---|---|---|---|
| FIRST ACOUSTIC APPARATUS | 192.168.0.11 | A1 : B1 : D1:1F:11:B1 | LIVING ROOM | A1 | FL |
| SECOND ACOUSTIC APPARATUS | 192.168.0.12 | A1 : B1 : D1:1F:11:B2 | LIVING ROOM | | |
| THIRD ACOUSTIC APPARATUS | 192.168.0.13 | A1 : B1 : D1:1F:11:B3 | LIVING ROOM | | |
| FOURTH ACOUSTIC APPARATUS | 192.168.0.14 | A1 : B1 : D1:1F:11:B4 | LIVING ROOM | | |
| FIFTH ACOUSTIC APPARATUS | 192.168.0.15 | A1 : B1 : D1:1F:11:B5 | BEDROOM | | |
| SIXTH ACOUSTIC APPARATUS | 192.168.0.16 | A1 : B1 : D1:1F:11:B6 | BEDROOM | | |

INFORMATION PROCESSING DEVICE, INFORMATION PROCESSING SYSTEM, AND INFORMATION PROCESSING METHOD

CROSS REFERENCE TO RELATED APPLICATIONS

The present application is a continuation of International Application No. PCT/JP2017/022800, filed on Jun. 21, 2017, the entire contents of which are incorporated herein by reference.

BACKGROUND OF THE INVENTION

1. Field of the Invention

One embodiment of the present invention relates to an information processing device, an information processing system, and an information processing method, and especially, is an information processing device, an information processing system, and an information processing method that specify a disposed position of an acoustic apparatus.

2. Description of the Related Art

Conventionally, there is a multichannel audio system that has a plurality of channels and includes speakers corresponding to the number of these channels (e.g., International publication No. 2008/126161).

In the multichannel audio system, a signal processing unit of an amplifier device performs channel allocation processing in order to construct a multichannel reproduction environment. Thus, the multichannel audio system determines where a plurality (nine) of speakers, which are to be used, each are located (determine positions of the plurality of speakers).

In the channel allocation processing, a user disposes microphones on left, right, front, and rear sides of a viewing position, and each microphone collects a measurement sound outputted from each speaker. The sound collection data, which is collected by the microphones, is used to measure a position of each microphone and a distance from each speaker. Based on these distances, the multichannel audio system determines where the plurality of speakers each are located.

To specify positions of a plurality of speakers (acoustic apparatuses), the multichannel audio system (information processing device) in International publication No. 2008/126161 uses microphones. In the multichannel audio system, four measurements are required for each of the plurality of speakers. Further, the multichannel audio system employs one microphone, and a user sequentially disposes the microphone at four points, i.e., the front, rear, left and right sides of a viewing position. In such a multichannel audio system, a number of measurements are required. In addition to this, a user needs to move the microphone. Therefore, it takes time to specify positions of the plurality of speakers. As a result, in the multichannel audio system of International publication No. 2008/126161, construction work of multichannel reproduction environment is likely to be complicated.

SUMMARY

Accordingly, an object of the present invention is to provide an information processing device, an information processing system, and an information processing method that can specify a disposed position of an acoustic apparatus more simply.

An information processing device according to one embodiment of the present invention includes an outputter that outputs a detection signal to a plurality of acoustic apparatuses; a receiver that receives a disposed position of each of the plurality of acoustic apparatuses, based on a response signal outputted from the plurality of acoustic apparatuses that have received the detection signal; a storage that stores disposition data indicating disposed positions of the plurality of acoustic apparatuses; and a position specifying processor that allocates the disposed position received by the receiver to any one of the plurality of acoustic apparatuses included in the disposition data, and causes the storage to store the disposed position allocated to the disposition data.

According to one embodiment of the present invention, a disposed position of an acoustic apparatus can be specified more simply.

BRIEF DESCRIPTION OF THE DRAWINGS

FIG. 5 is a correspondence table exemplarily showing information on a plurality of acoustic apparatuses.

DETAILED DESCRIPTION OF THE EMBODIMENTS

An information processing device 4, an information processing program, and an information processing system 10 according to one embodiment of the present invention will be described with reference to the drawings.

Figure 1:
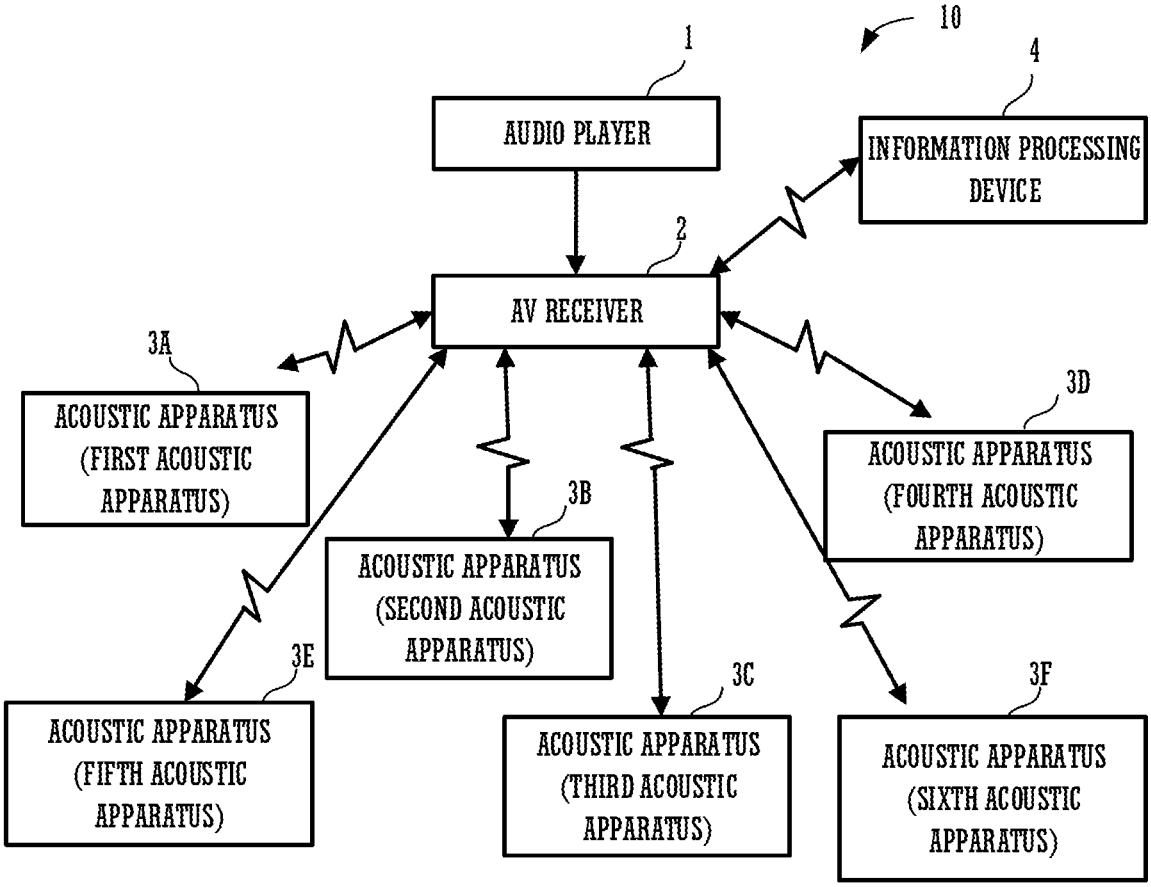
FIG. 1 is a block diagram showing a configuration of an information processing system.
Figure 2:
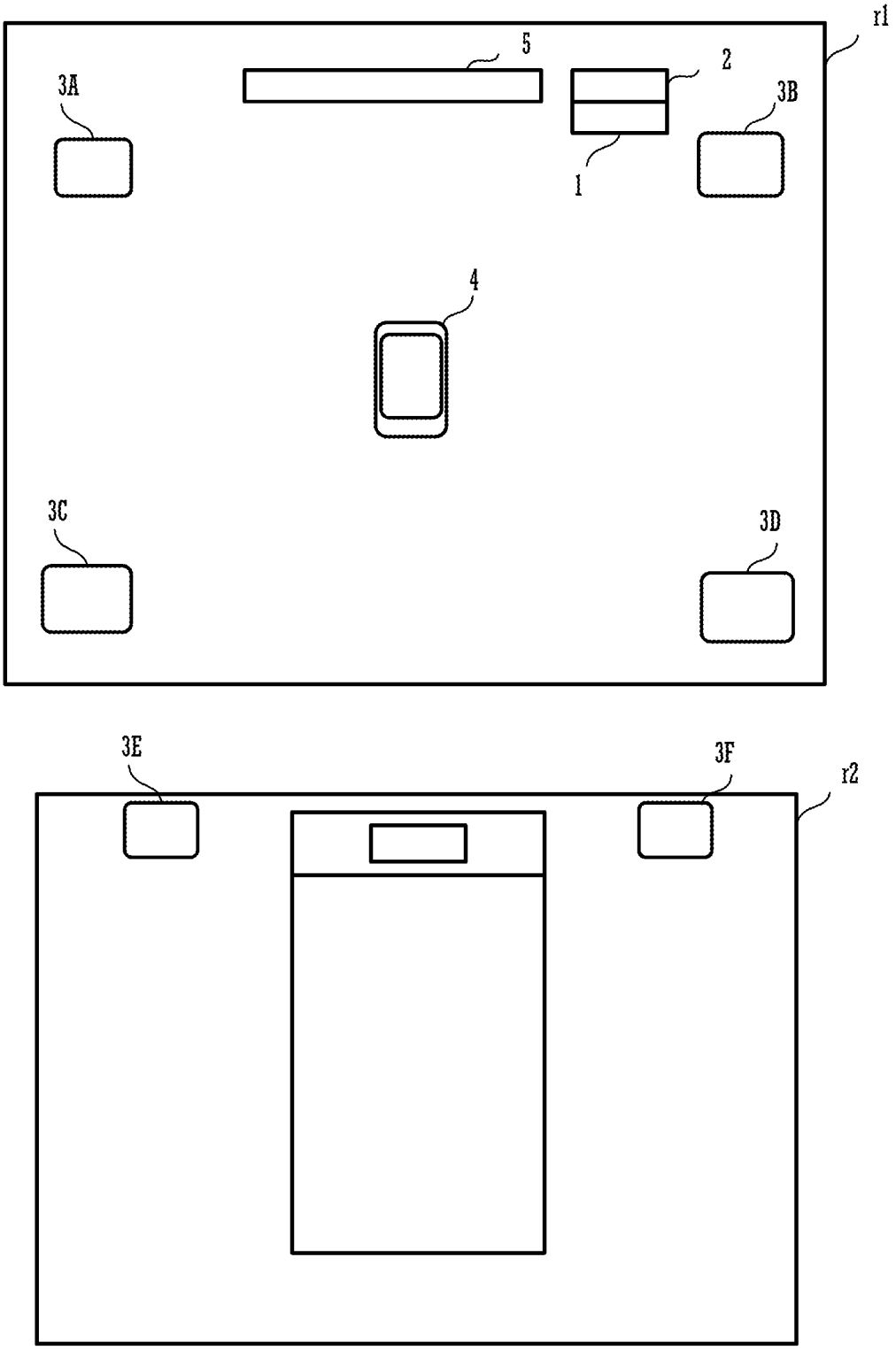
FIG. 2 is a schematic view exemplarily showing spaces in which the information processing system is configured.

First, the information processing system 10 will be described with reference to FIGS. 1 and 2. FIG. 1 is a block diagram showing a configuration of the information processing system 10 according to one embodiment of the present invention. FIG. 2 is a schematic diagram exemplarily showing spaces (living room r1 and bedroom r2) in which the information processing system 10 is configured.

In the information processing device 4, the information processing program, and the information processing system 10 of the present embodiment, the information processing device 4 specifies acoustic apparatuses 3A to 3F to which contents are to be distributed. In the information processing device 4, the information processing program, and the information processing system 10, disposed positions of the acoustic apparatuses to which contents are to be distributed are specified, and channel setting of these acoustic apparatuses is performed.

As shown in FIG. 1, the information processing system 10 includes an audio player 1, an AV receiver 2, a plurality of acoustic apparatuses 3A to 3F, and the information processing device 4. The information processing system 10 is in an indoor room having a plurality of spaces, for example, and outputs contents (music) reproduced by the audio player 1 from one acoustic apparatus or the plurality of acoustic apparatuses 3A to 3F. The plurality of acoustic apparatuses 3A to 3F can be moved within one space (room), or to another space. In other words, the plurality of acoustic apparatuses 3A to 3F are not always disposed in the same positions of the same space. The information processing system 10 specifies the acoustic apparatuses 3A to 3F disposed in a user-desired space and configures the acoustic apparatuses 3A to 3F to output suitable contents. Through user's operation of the information processing device 4, the information processing system 10 estimates a position of the space in which an acoustic apparatus disposed in the user-desired space, among the plurality of acoustic apparatuses 3A to 3F, is located.

The audio player 1 is an apparatus for reproducing contents, e.g., a CD player or a DVD player. In the information processing system 10 of the present embodiment, the audio player 1 is disposed in a living room r1, as shown in FIG. 2. The audio player 1 is connected to the AV receiver 2, with wireless or wired communication. The audio player 1 transmits the reproduced contents to the AV receiver 2. Note that, it is not limited to the example in which the audio player 1 is disposed in the living room r1. The audio player 1 may be disposed in a bedroom r2. Further, the information processing system 10 may include a plurality of audio players 1.

By using a router with a wireless access point function, the AV receiver 2 constructs a wireless LAN. The AV receiver 2 is connected to the audio player 1, the plurality of acoustic apparatuses 3A to 3F, and the information processing device 4 through the wireless LAN, for example.

For instance, as shown in FIG. 2, the AV receiver 2, which is located in the living room r1, is disposed near a television 5. Note that, it is not limited to the example in which the AV receiver 2 is disposed near the television 5. The AV receiver 2 may be disposed in an indoor room such as the bedroom r2.

Note that, it is not limited to the example in which the AV receiver 2 obtains contents from the audio player 1. The AV receiver 2 may download contents (e.g., Internet radio) from a contents server through the Internet, for example. Further, the AV receiver 2 may be connected to the plurality of acoustic apparatuses 3A to 3F through a LAN cable. Further, the AV receiver 2 may have a function of the audio player 1.

The plurality of acoustic apparatuses 3A to 3F are apparatuses having a speaker or a speaker function, for example. The plurality of acoustic apparatuses 3A to 3F are disposed in a plurality of different indoor spaces such as the living room r1 and the bedroom r2. The plurality of acoustic apparatuses 3A to 3F output sounds based on a signal outputted from the AV receiver 2. The plurality of acoustic apparatuses 3A to 3F are connected to the AV receiver 2, wirelessly or through a wire.

The information processing device 4 is a portable mobile terminal such as a smart phone. By using a dedicated application that is downloaded into the information processing device 4 in advance, a user performs transmission and reception of information between the AV receiver 2 and the information processing device 4.

Figure 3:
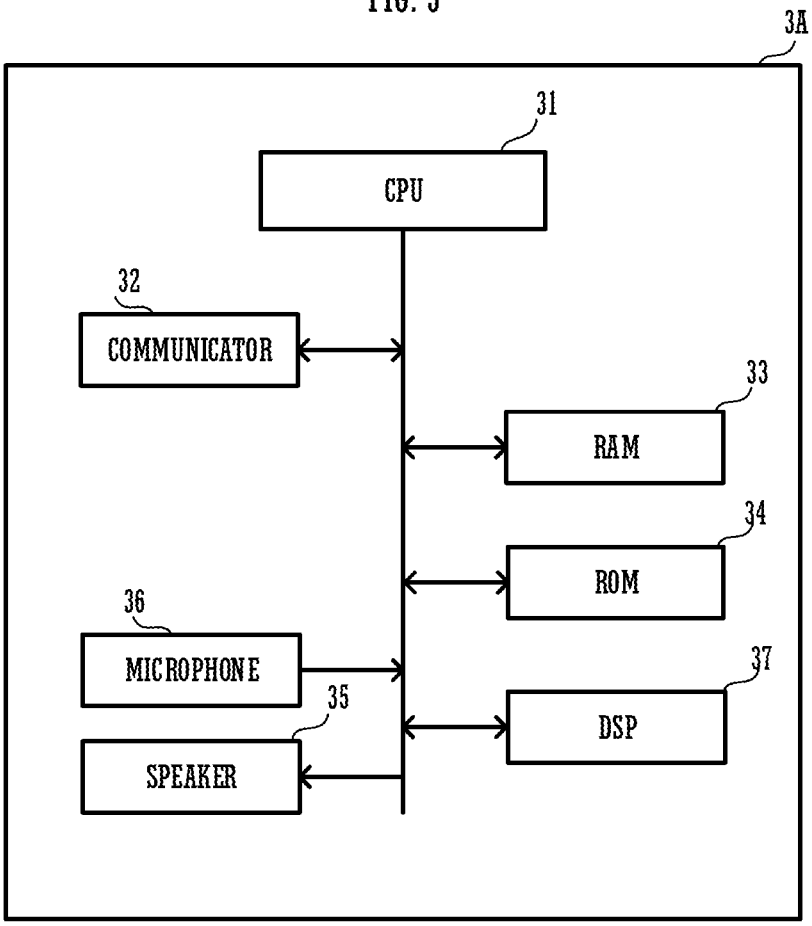
FIG. 3 is a block diagram showing a configuration of an acoustic apparatus.
Figure 4:
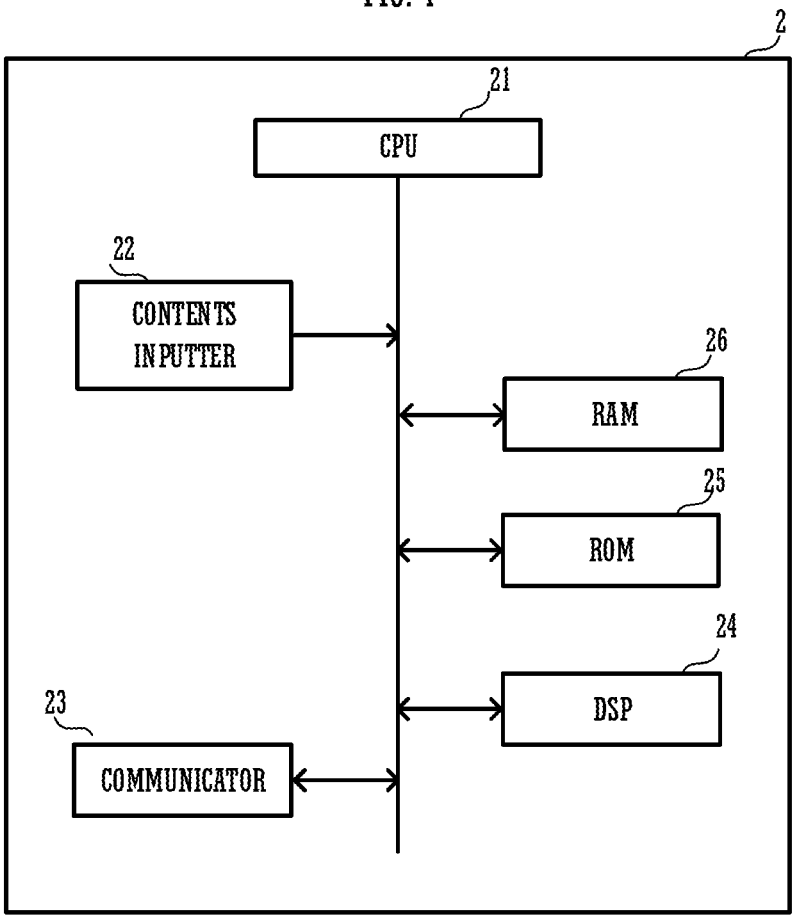
FIG. 4 is a block diagram showing a configuration of an AV receiver.

Next, the AV receiver 2, the plurality of acoustic apparatuses 3A to 3F, and the information processing device 4 according to the present embodiment will be described in detail. FIG. 3 is a block diagram showing a configuration of each acoustic apparatus. FIG. 4 is a block diagram showing a configuration of the AV receiver 2.

Among the plurality (six in FIG.1) of acoustic apparatuses 3A to 3F, a first acoustic apparatus 3A, a second acoustic apparatus 3B, a third acoustic apparatus 3C, and a fourth acoustic apparatus 3D are disposed in the living room r1, as shown in FIG. 2. The first acoustic apparatus 3A, the second acoustic apparatus 3B, the third acoustic apparatus 3C, and the fourth acoustic apparatus 3D each are disposed in different positions of the living room r1. Further, among the plurality of acoustic apparatuses 3A to 3F, a fifth acoustic apparatus 3E and a sixth acoustic apparatus 3F are disposed in the bedroom r2. The fifth acoustic apparatus 3E and the sixth acoustic apparatus 3F each are disposed in different positions of the bedroom r2. Note that, for the plurality of acoustic apparatuses 3A to 3F, the number of acoustic apparatuses and the disposed positions are not limited to the example shown in the present embodiment.

In FIG. 3, the first acoustic apparatus 3A will be described as an example. Note that, other acoustic apparatuses (the second acoustic apparatus 3B, the third acoustic apparatus 3C, the fourth acoustic apparatus 3D, the fifth acoustic apparatus 3E, and the sixth acoustic apparatus 3F) all have the same configuration and function. The first acoustic apparatus 3A includes a CPU 31, a communicator 32, a RAM 33, a ROM 34, a speaker 35 and DSP 37. Besides, the first acoustic apparatus 3A further includes a microphone 36.

The CPU 31 controls the communicator 32, the RAM 33, the ROM 34, the speaker 35, and the microphone 36.

The communicator 32 is a wireless communicator according to Wi-Fi (registered trademark) standards, for example. The communicator 32 communicates with the AV receiver 2 through a router equipped with wireless access points. Similarly, the communicator 32 can communicate with the information processing device 4.

The ROM 34 is a storage medium. The ROM 34 stores a program for operating the CPU 31. The CPU 31 reads the program, which is stored in the ROM 34, into the RAM 33 to execute it, thereby performing various kinds of processing.

The speaker 35 has a D/A converter that converts a digital audio signal into an analog audio signal, and an amplifier that amplifies the audio signal. The speaker 35 outputs a sound (e.g., music or the like) based on a signal inputted from the AV receiver 2 through the communicator 32.

The microphone 36 receives an estimation signal (e.g., a test sound) outputted from the information processing device 4. In other words, the microphone 36 collects the test sound serving as the estimation signal outputted from the information processing device 4. When the microphone 36 collects the test sound, the CPU 31 outputs a beep sound as a response signal. Note that, the response signal is outputted from the speaker 35.

Note that, the response signal is not limited to only a test sound. The CPU 31 may transmit the response signal to the information processing device 4 as data, directly or through the communicator 32. Further, as the response signal, light or both the test sound and light may be employed. In this case, the first acoustic apparatus 3A has a light emitting element such as an LED. The CPU 31 causes the light emitting element to emit light as the response signal.

As shown in FIG. 4, the AV receiver 2 includes a CPU 21, a contents inputter 22, a communicator 23, a DSP 24, a ROM 25, and a RAM 26.

The CPU 21 controls the contents inputter 22, the communicator 23, the DSP 24, the ROM 25, and the RAM 26.

The contents inputter 22 communicates with the audio player 1, wirelessly or through a wire. The contents inputter 22 obtains contents from the audio player 1.

The communicator 23 is a wireless communicator according to Wi-Fi (registered trademark) standards, for example. The communicator 23 communicates with each of the plurality of acoustic apparatuses 3A to 3F through a router equipped with wireless access points. Note that, if the AV receiver 2 has a router function, the communicator 23 communicates with each of the plurality of acoustic apparatuses 3A to 3F, directly.

The DSP 24 applies various kinds of signal processing on the signal inputted to the contents inputter 22. When receiving encoded data as a signal of contents, the DSP 24 decodes the encoded data to perform the signal processing such as extracting an audio signal.

The ROM 25 is a storage medium. The ROM 25 stores a program for operating the CPU 21. The CPU 21 reads the program, which is stored in the ROM 25, into the RAM 26 to execute it, thereby performing various kinds of processing.

Further, the ROM 25 stores information on the plurality of acoustic apparatuses 3A to 3F. FIG. 5 is a correspondence table showing an example of the information on the plurality of acoustic apparatuses 3A to 3F, which is stored in the ROM 25. Each of the plurality of acoustic apparatuses 3A to 3F is mutually associated with information such as an IP address, a MAC Address, a disposition place (disposed position), a channel, and stored in the ROM 25.

The communicator 23 receives data from the information processing device 4. The contents inputter 22 obtains contents of the audio player 1 based on the received data. The communicator 23 transmits an audio data to each of the plurality of acoustic apparatuses 3A to 3F, based on the contents received from the audio player 1 through the content inputter 22.

Further, the communicator 23 performs transmission and reception of data with the information processing device 4. When receiving a setting operation or the like from a user, the information processing device 4 transmits a start notification to the AV receiver 2. The communicator 23 receives the start notification that is transmitted from the information processing device 4. When the communicator 23 receives the start notification, the communicator 23 transmits a sound-collection start notification to the plurality of acoustic apparatuses 3A to 3F such that microphones 36 of the plurality of acoustic apparatuses 3A to 3F turn into a sound-collection state. Furthermore, according to a timeout or a user's operation, the information processing device 4 transmits an end notification to the AV receiver 2. The communicator 23 receives the end notification from the information processing device 4. If the microphone 36 of each of the plurality of acoustic apparatuses 3A to 3F is in a sound-collection state, the communicator 23 transmits a sound-collection end notification to each of the plurality of acoustic apparatuses 3A to 3F such that the microphone 36 of each of the plurality of acoustic apparatuses 3A to 3F turns into a sound-collection stop state.

By the way, a corresponding one of inherent IP addresses (local addresses) is assigned to each of the first acoustic apparatus 3A, the second acoustic apparatus 3B, the third acoustic apparatus 3C, the fourth acoustic apparatus 3D, the fifth acoustic apparatus 3E, and the sixth acoustic apparatus 3F. For example, the AV receiver 2 assigns an IP address to each of the first acoustic apparatus 3A, the second acoustic apparatus 3B, the third acoustic apparatus 3C, the fourth acoustic apparatus 3D, the fifth acoustic apparatus 3E, and the sixth acoustic apparatus 3F. Note that, the IP address of the first acoustic apparatus 3A, the second acoustic apparatus 3B, the third acoustic apparatus 3C, the fourth acoustic apparatus 3D, the fifth acoustic apparatus 3E, and the sixth acoustic apparatus 3F may be assigned by a router or the like.

Further, the first acoustic apparatus 3A, the second acoustic apparatus 3B, the third acoustic apparatus 3C, the fourth acoustic apparatus 3D, the fifth acoustic apparatus 3E, and the sixth acoustic apparatus 3F each have a corresponding one of MAC addresses serving as individual identification information. Note that, the individual identification information may be any other information, such as a serial number or an ID number, that is able to identify the first acoustic apparatus 3A, the second acoustic apparatus 3B, the third acoustic apparatus 3C, the fourth acoustic apparatus 3D, the fifth acoustic apparatus 3E, and the sixth acoustic apparatus 3F. The IP addresses and the MAC addresses are previously associated with the plurality of acoustic apparatuses 3A to 3F one by one. Information on the association is stored in the AV receiver 2.

Figure 6:
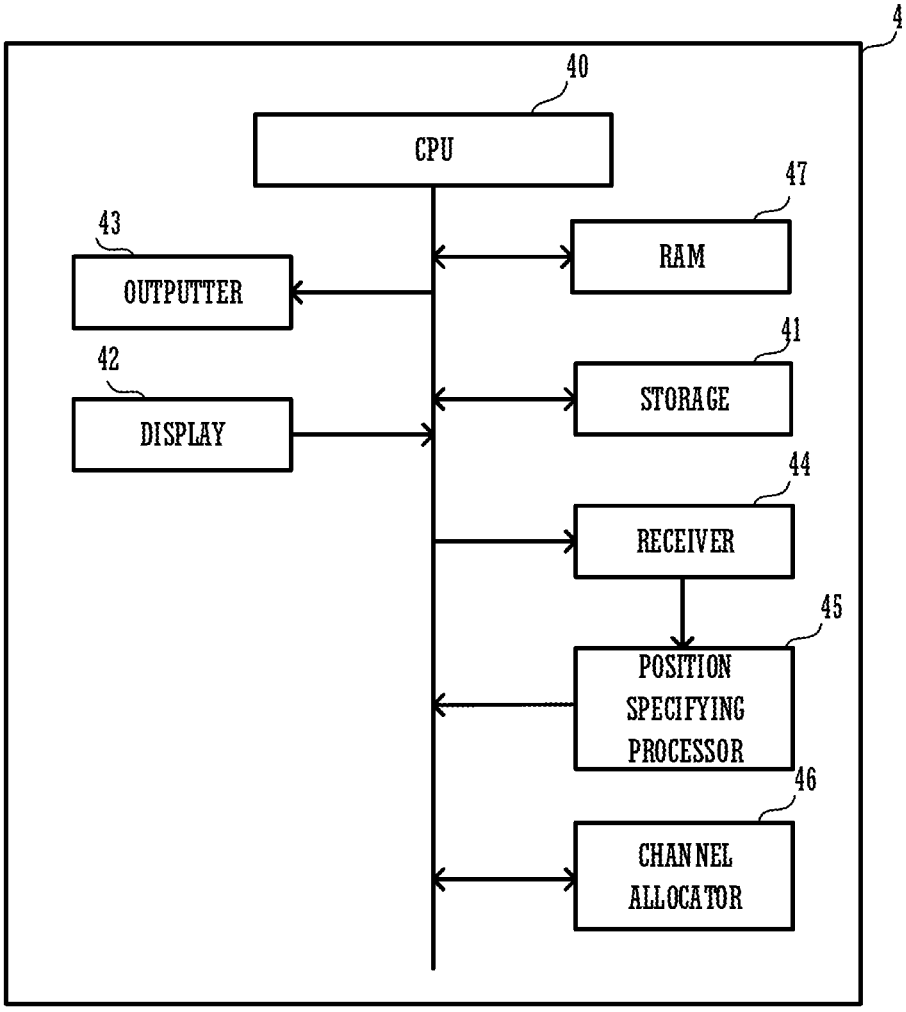
FIG. 6 is a block diagram showing a configuration of an information processing device.

The information processing device 4 is a portable mobile terminal such as a smart phone, for example. FIG. 6 is a block diagram showing a configuration of the information processing device 4. The information processing device 4 includes a CPU 40, a storage 41, a display 42, an outputter 43, a receiver 44, a position specifying processor 45, a channel allocator 46, and a RAM 47. Further, in addition to the above-mentioned configuration, the information processing device 4 has a function and a configuration provided in a smart phone.

Note that, the information processing devices 4 may be a user operable device such as a tablet, a smart watch, or a PC.

For instance, the CPU40 reads the program, which is stored in the storage 41, into the RAM 47 to execute it, thereby performing various kinds of processing.

The outputter 43 transmits an estimation signal for estimating disposed positions of the plurality of acoustic apparatuses 3A to 3F, which are located in a predetermined space, in the space. The acoustic apparatuses that have received the estimation signal output a detection signal. The outputter 43 has a speaker, a light emitting element, an infrared transmitter, an antenna, or the like, and can output a sound, light, infrared rays, or a signal. In the information processing device 4 of the present embodiment, the outputter 43 outputs a sound, e.g., a beep sound from the speaker as the estimation signal. The outputter 43, for example, outputs the beep sound large enough to be collected by only the plurality of acoustic apparatuses (e.g., the first acoustic apparatus 3A, the second acoustic apparatus 3B, the third acoustic apparatus 3C, and the fourth acoustic apparatus 3D) disposed in the predetermined space (e.g., living room r1). Thus, in the information processing system 10, only the acoustic apparatus (e.g., the first acoustic apparatus 3A, the second acoustic apparatus 3B, the third acoustic apparatus 3C, and the fourth acoustic apparatus 3D) that have collected the beep sound are subjected to estimation process.

Note that, the estimation signal is not limited to only a sound, but may be light, infrared rays, or the like. For instance, as the estimation signal, the outputter 43 may cause the light emitting element to emit light. Further, the outputter 43 outputs infrared rays from the infrared transmitter.

Furthermore, the outputter 43 outputs a detection signal to the plurality of acoustic apparatuses (e.g., the first acoustic apparatus 3A, the second acoustic apparatus 3B, the third acoustic apparatus 3C, and the fourth acoustic apparatus 3D). More specifically, the outputter 43 outputs the estimation signal to the acoustic apparatuses (e.g., the first acoustic apparatus 3A, the second acoustic apparatus 3B, the third acoustic apparatus 3C, and the 4th acoustic apparatus 3D) to be subjected to the estimation process, directly or through the AV receiver 2. The outputter 43 outputs the detection signal to a user-desired acoustic apparatus (e.g., the first acoustic apparatus 3A), directly or through the AV receiver 2.

Further, the outputter 43 transmits a start notification for announcing a start of estimation processing to the plurality of acoustic apparatuses 3A to 3F, directly or through the AV receiver 2. Thus, the plurality of acoustic apparatuses 3A to 3F each set the microphone 36 in the sound-collection state. Furthermore, the outputter 43 outputs an end notification for announcing an end of the estimation processing to the plurality of acoustic apparatuses 3A to 3F, directly or through the AV receiver 2. Thus, the plurality of acoustic apparatuses 3A to 3F each set the microphone 36 in the sound-collection stop state.

The storage 41 stores various kinds of programs to be executed by the CPU 40. Further, the storage 41 stores disposition data indicating disposed positions of the plurality of acoustic apparatuses 3A to 3F in the space. The disposition data is data in which the plurality of acoustic apparatuses 3A to 3F, the spaces, and the disposed positions are associated with one another. By allocation processing, the plurality of acoustic apparatuses 3A to 3F each are associated with a corresponding one of the spaces in which the plurality of acoustic apparatuses 3A to 3F are disposed, and stored in the storage 41. For instance, the storage 41 stores disposition data in which the first acoustic apparatus 3A, the second acoustic apparatus 3B, the third acoustic apparatus 3C, and the fourth acoustic apparatus 3D, which are disposed in the living room r1, are associated with the living room r1. Further, the storage 41 stores disposition data in which the fifth acoustic apparatus 3E and the sixth acoustic apparatus 3F, which are disposed in the bedroom r2, are associated with the bedroom r2.

For instance, the disposed positions are information indicating positions of the living room r1 in which the first acoustic apparatus 3A, the second acoustic apparatus 3B, the third acoustic apparatus 3C, and the fourth acoustic apparatus 3D are disposed. By position specifying processing, the plurality of acoustic apparatuses 3A to 3F each are associated with a corresponding one of the disposed positions of the plurality of acoustic apparatuses 3A to 3F, and stored in the storage 41.

The display 42 has a screen, e.g., an LCD (Liquid Crystal Display), for displaying an application downloaded by the information processing device 4. A user can tap, slide, or the like on the screen to operate the application.

Figure 7:
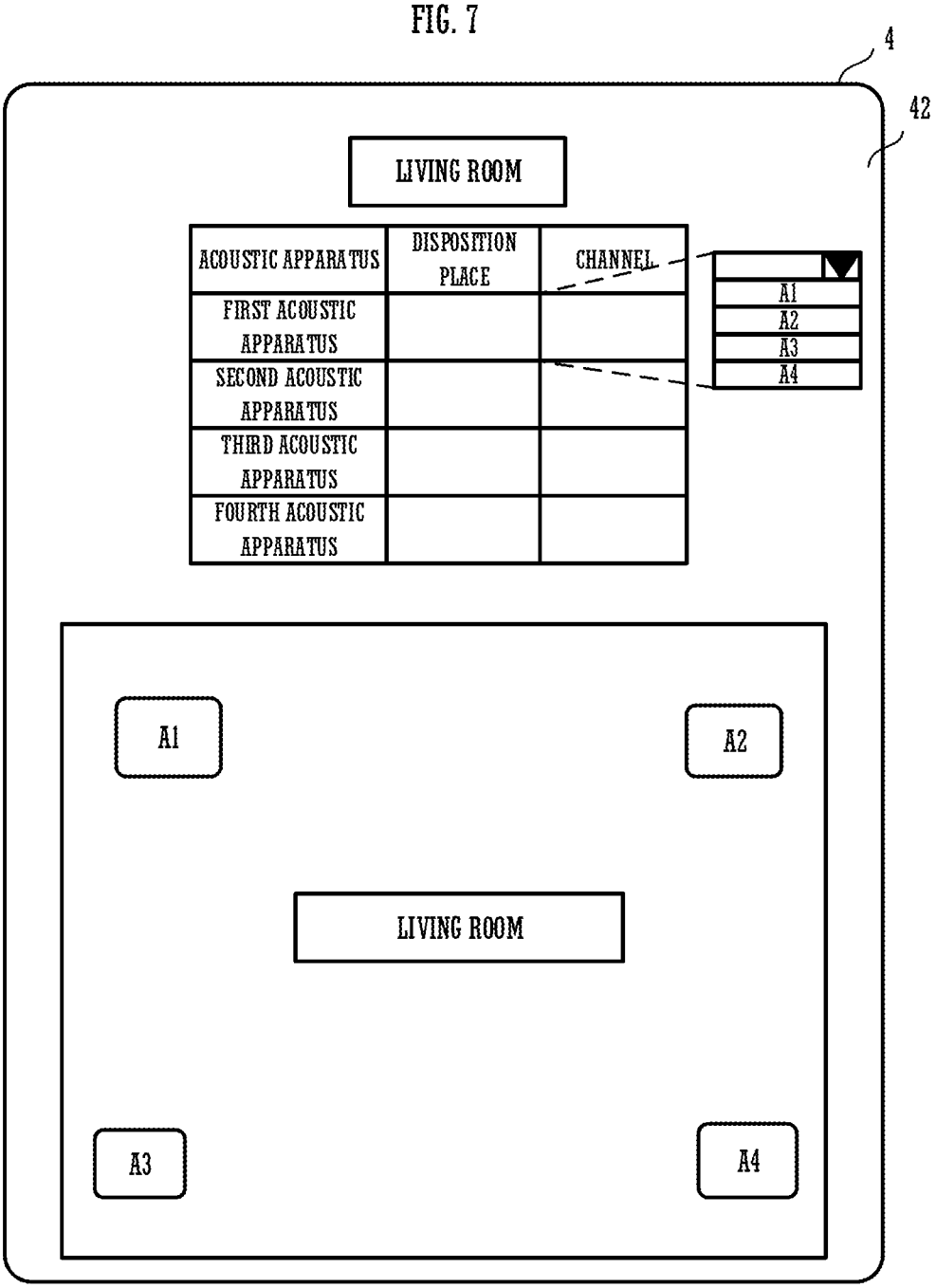
FIG. 7 is an explanatory view exemplarily showing a layout drawing displayed on a display.

The display 42 displays a layout drawing based on the disposition data. FIG. 7 is an explanatory view showing an example of the layout drawing displayed on the display 42. As shown in FIG. 7, a correspondence table is displayed on an upper part of the screen in the display 42. In the correspondence table, the first acoustic apparatus 3A, the second acoustic apparatus 3B, the third acoustic apparatus 3C, and the fourth acoustic apparatus 3D, which are disposed in the living room r1, are associated with disposed positions, selected later, and channels. Further, a simplified diagram (layout drawing) simulating the living room r1 is displayed on a lower part of the screen. The layout drawing displays disposition places A1 to A4 indicating the disposed positions of the acoustic apparatuses. Accordingly, a user operates the screen such that the first acoustic apparatus 3A, the second acoustic apparatus 3B, the third acoustic apparatus 3C, and the fourth acoustic apparatus 3D correspond to the disposition places A1 to A4 one by one, so that the first acoustic apparatus 3A, the second acoustic apparatus 3B, the third acoustic apparatus 3C and the fourth acoustic apparatus 3D are associated with the disposition places A1 to A4.

For instance, the receiver 44, which is constituted by a touch panel, receives the disposed position of the each first acoustic apparatus 3A, the second acoustic apparatus 3B, the third acoustic apparatus 3C, and the fourth acoustic apparatus 3D. For instance, in the case where the response signal is a sound, a user determines which acoustic apparatus is the acoustic apparatus (e.g., the first acoustic apparatus 3A) outputting the sound. The user selects, on the screen, where in the disposition places A1 to A4 the acoustic apparatus (e.g., the first acoustic apparatus 3A) outputting the sound is. On the screen of the display 42, the acoustic apparatuses 3A to 3F each are displayed line by line, as shown in FIG. 7. To each of the first acoustic apparatus 3A, the second acoustic apparatus 3B, the third acoustic apparatus 3C, and the fourth acoustic apparatus 3D, the user, for example, selects any one of the disposition places A1 to A4 from a pulldown list or the like.

Further, the receiver 44 receives a center position. More specifically, when a user touches any of the layout drawing displayed on the lower part of the screen shown in FIG. 7, the receiver 44 receives the center position.

The position specifying processor 45 allocates each of the disposition places A1 to A4 of the acoustic apparatuses that have been received by the receiver 44, to any one of the plurality of acoustic apparatuses 3A to 3F included in the disposition data. The storage 41 stores the disposition places A1 to A4 that have been allocated to the acoustic apparatuses 3A to 3F included in the disposition data. In other words, by the position specifying processor 45, the disposition places A1 to A4, which have been received by the receiver 44, of the first acoustic apparatus 3A, the second acoustic apparatus 3B, the third acoustic apparatus 3C, and the fourth acoustic apparatus 3D each are allocated to a column of disposition shown in FIG. 5. The storage 41 stores disposition data in which the first acoustic apparatus 3A, the second acoustic apparatus 3B, the third acoustic apparatus 3C, and the fourth acoustic apparatus 3D each are associated with a corresponding one of the allocated disposition places A1 to A4.

For the acoustic apparatuses (e.g., the first acoustic apparatus 3A, the second acoustic apparatus 3B, the third acoustic apparatus 3C, and the fourth acoustic apparatus 3D) to be subjected to the allocation, the channel allocator 46 allocates a channel to each of the plurality of acoustic apparatuses (e.g., the first acoustic apparatus 3A, the second acoustic apparatus 3B, the third acoustic apparatus 3C, and the fourth acoustic apparatus 3D), in correspondence to the center position that has been received by the receiver 44. Further, when a first center position which is a center position newly received by the receiver 44 and a second center position which is a center position already stored in the storage 41 are different from each other, the channel allocator 46 reallocates a channel that corresponds to the first center position, to each of the plurality of acoustic apparatuses (e.g., the first acoustic apparatus 3A, the second acoustic apparatus 3B, the third acoustic apparatus 3C, and the fourth acoustic apparatus 3D). The storage 41 stores the center position received by the receiver 44. Note that, the information processing device 4 is preferably configured such that contents of the channel are transmitted to the AV receiver 2.

In the information processing system 10 of the present embodiment, as shown in FIG. 2, a place at which a television 5 is disposed can be defined as a center position in the living room r1, for example. In the information processing system 10 of the present embodiment, the channel allocator 46 sets an acoustic apparatus disposed on a left-hand side toward the center position to a channel of the acoustic apparatus to a channel FL. Further, the channel allocator 46 sets an acoustic apparatus disposed on a right-hand side toward the center position to a channel of the acoustic apparatus to a channel FR. Furthermore, when the center position is located on a front side, the channel allocator 46 sets an acoustic apparatus disposed on a rear left-hand side to a channel of the acoustic apparatus to a channel SL. Further, the channel allocator 46 sets an acoustic apparatus disposed on a rear right-hand side to a channel of the acoustic apparatus to a channel SR.

Furthermore, by operating the information processing device 4, a user can set the television 5 to the center position. Accordingly, when the information processing system 10 is used at the next time, it is not necessary for a user to input a center position again, because the storage 41 stores the center position. As a result, in the information processing device 4 and the information processing system 10 of the present embodiment, the time required for channel setting can be shortened.

The information processing device 4 and the information processing system 10 of the present embodiment can specify the acoustic apparatuses (e.g., the first acoustic apparatus 3A, the second acoustic apparatus 3B, the third acoustic apparatus 3C, and the fourth acoustic apparatus 3D) disposed in a user-desired space, e.g., the living room r1. Further, the information processing device 4 and the information processing system 10 of the present embodiment can detect disposed positions of the specified acoustic apparatuses (e.g., the first acoustic apparatus 3A, the second acoustic apparatus 3B, the third acoustic apparatus 3C, and the fourth acoustic apparatus 3D). As a result, the information processing device and the information processing system 10 of the present embodiment can specify disposed positions of the acoustic apparatuses 3A to 3F more simply. Further, in the information processing device 4 and the information processing system 10 of the present embodiment, the channel setting of the specified acoustic apparatuses (e.g., the first acoustic apparatus 3A, the second acoustic apparatus 3B, the third acoustic apparatus 3C, and the fourth acoustic apparatus 3D) will be possible as appropriate by specifying the center position.

By the way, the information processing device 4 can achieve various kinds of functions, mentioned above, by using an information processing program executed by the CPU 40 existed in the information processing device 4. By executing the information processing program, disposed positions of the acoustic apparatuses 3A to 3F can be specified more simply.

Figure 8:
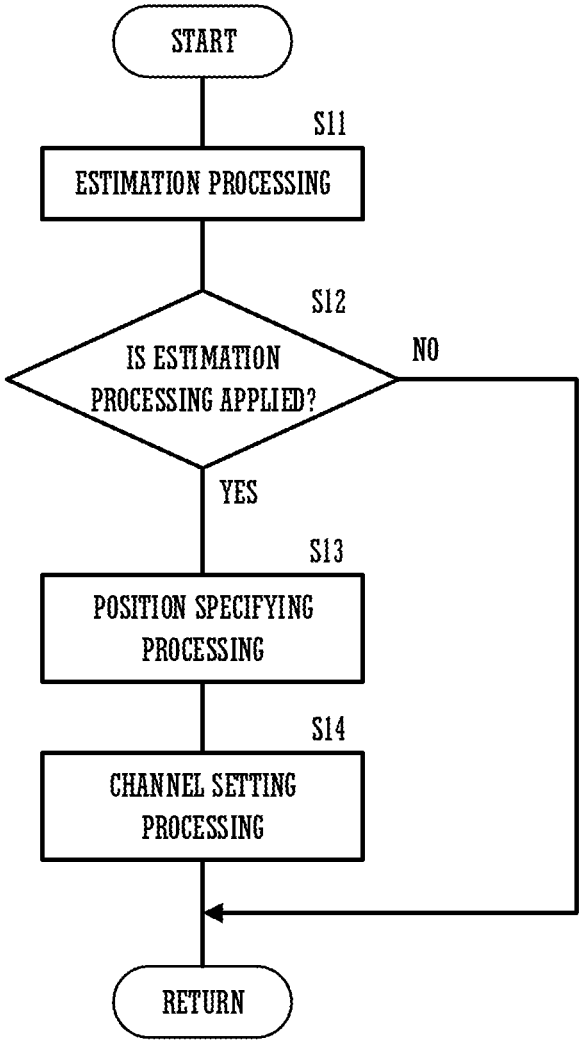
FIG. 8 is a flowchart showing an operation of the information processing system.

Herein, an operation of the information processing system 10 will be described with reference to FIGS. 8 through 11. FIG. 8 is a flowchart showing the operation of the information processing system 10. Note that, as a precondition, the storage 24 of the AV receiver 2 stores data in which each of the plurality of acoustic apparatuses 3A to 3F is associated with an IP address and a MAC address corresponding to each of the plurality of acoustic apparatuses 3A to 3F. Further, the information processing device 4 can receive the above-mentioned data. Still further, a user carries the information processing device 4 to operate the information processing device 4 at the center of living room r1, as shown in FIG. 2. Furthermore, the user can watch the correspondence table shown in FIG. 5 on the screen. Further, a user-desired center position is set to the position at which the television 5 is disposed.

The information processing system 10 performs estimation processing that estimates an acoustic apparatus to be subjected to the estimation process, among the plurality of acoustic apparatuses 3A to 3F (Step S11). For the acoustic apparatus that have determined to be subjected to the estimation process among the plurality of acoustic apparatuses 3A to 3F (Step S12: YES), e.g., the first acoustic apparatus 3A, the second acoustic apparatus 3B, the third acoustic apparatus 3C, and the fourth acoustic apparatus 3D, the information processing system 10 performs position specifying processing (Step S13). When the disposed positions of the first acoustic apparatus 3A, the second acoustic apparatus 3B, the third acoustic apparatus 3C, and the fourth acoustic apparatus 3D are specified, the information processing system 10 receives the center position, and performs channel setting processing (Step S14).

Note that, for the acoustic apparatuses (e.g., the fifth acoustic apparatus 3E and the sixth acoustic apparatus 3F) that have not determined to be subjected to the estimation process (Step S12: NO), the information processing system 10 completes the processing (shifted to RETURN).

Figure 9:
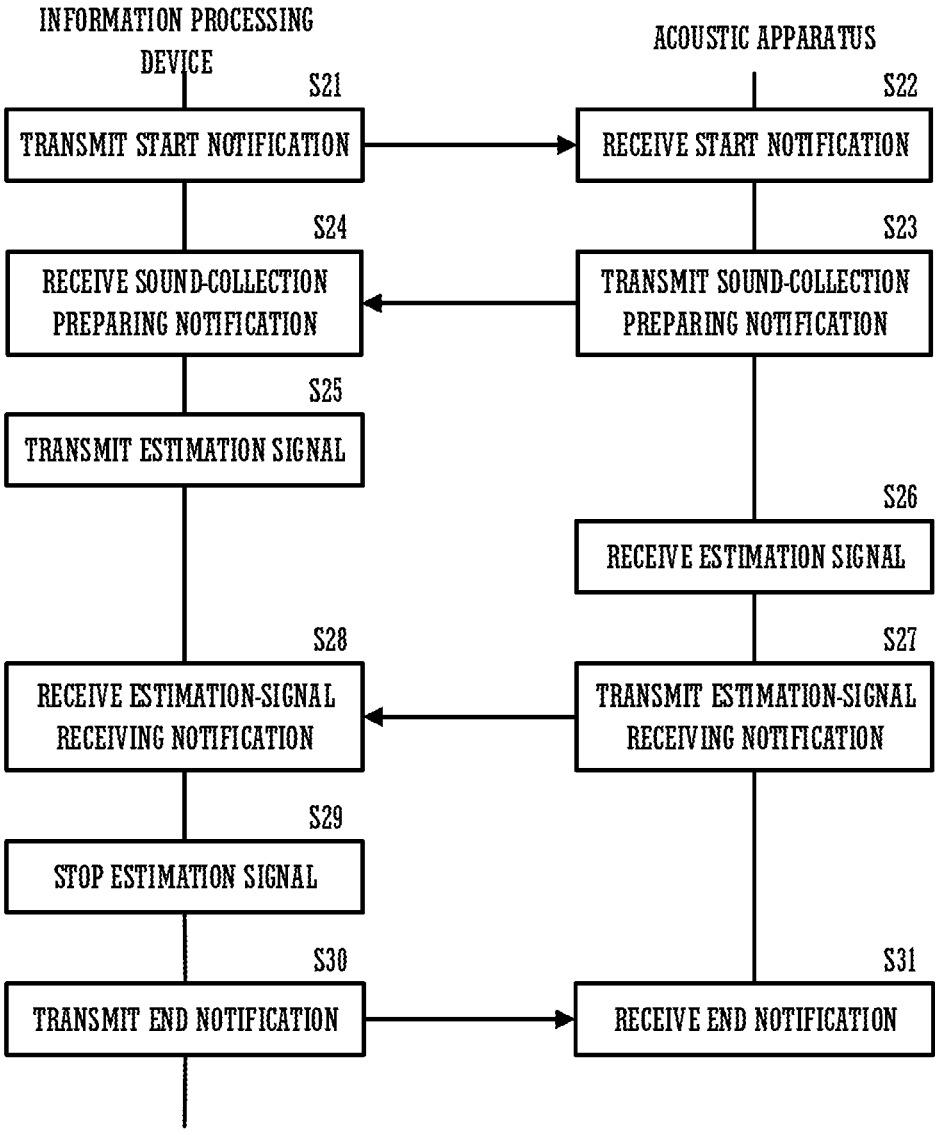
FIG. 9 is a flowchart showing operations of the information processing device and each acoustic apparatus in estimation processing of the information processing system.

The estimation processing of the information processing system 10 will be described. FIG. 9 is a flowchart showing operations of the information processing device 4 and each of the acoustic apparatuses 3A to 3F in the estimation processing of the information processing system 10. A user sets the information processing system 10 in a processing start state by operating an application on the screen. The outputter 43 of the information processing device 4 outputs a start notification to the plurality of acoustic apparatuses 3A to 3F through the AV receiver 2 (Step S21). At this time, the information processing device 4 sets a timeout (e.g., 5 seconds) for stopping the start notification in advance. Each of the plurality of acoustic apparatuses 3A to 3F receives the start notification (Step S22). Each of the plurality of acoustic apparatuses 3A to 3F turns the microphone 36 into a sound-collection possible state. Each of the plurality of acoustic apparatuses 3A to 3F announces a sound-collection preparing notification which indicates the microphone 36 set a sound-collection possible state to the information processing device through the AV receiver 2 (Step S23). The information processing device 4, when receiving the sound-collection preparing notification (Step S24), transmits an estimation signal (test sound) from the outputter 43 (Step S25).

Among the plurality of acoustic apparatuses 3A to 3F, the first acoustic apparatus 3A, the second acoustic apparatus 3B, the third acoustic apparatus 3C, and the fourth acoustic apparatus 3D, which are disposed in the living room r1, collect the estimation signal (Step S26). The first acoustic apparatus 3A, the second acoustic apparatus 3B, the third acoustic apparatus 3C, and the fourth acoustic apparatus 3D announces an estimation-signal receiving notification which indicates that the estimation signal has been collected to the information processing device 4, directly or through the AV receiver 2 (Step S27). The information processing device 4 receives the estimation-signal receiving notification (Step S28). At this time, the information processing device 4 displays on the display 42 the first acoustic apparatus 3A, the second acoustic apparatus 3B, the third acoustic apparatus 3C, and the fourth acoustic apparatus 3D, which have received the estimation signal. According to the timeout or user's manual operation, the information processing device 4 stops transmitting the estimation signal (Step S29). The information processing device 4 announces an end notification to the plurality of acoustic apparatuses 3A to 3F through the AV receiver 2 (Step S30). The plurality of acoustic apparatuses 3A to 3F receive the end notification (Step S31), and then stops the sound-collection state of the microphone 36 in the information processing system 10.

On the other hand, the fifth acoustic apparatus 3E and the sixth acoustic apparatus 3F, which are disposed in the bedroom r2, do not collect the estimation signal. The fifth acoustic apparatus 3E and the sixth acoustic apparatus 3F notify the information processing device 4, through the AV receiver 2, that the estimation signal is not collected. Note that, for the acoustic apparatuses (herein, the fifth acoustic apparatus 3E and the sixth acoustic apparatus 3F) in which sound-collection is not performed, it is not necessary to notify the information processing device 4 that the sound-collection is not performed, because the information processing device 4 specifies only the acoustic apparatuses that have collected the estimation signal.

In an information processing method of the present embodiment, a user can easily specify acoustic apparatuses in the user-desired space as necessary, because only the acoustic apparatuses that have received the estimation signal are subjected to the estimation process. As a result, in the information processing method of the present embodiment, a disposed position of an acoustic apparatus can be specified more simply.

Figure 10:
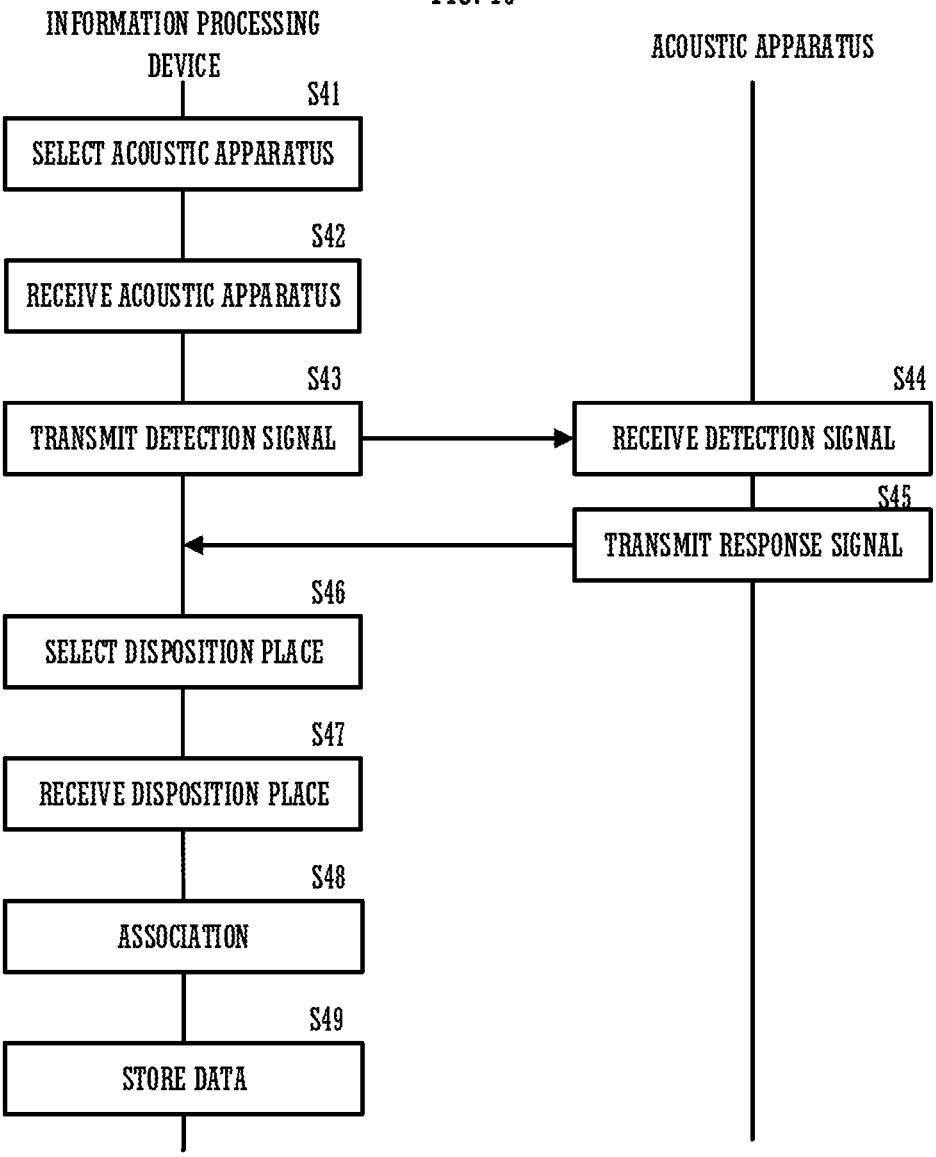
FIG. 10 is a flowchart showing operations of the information processing device and the acoustic apparatus in position specifying processing of the acoustic apparatus in the information processing system.

Next, position specifying processing will be described with reference to FIG. 10. FIG. 10 is a flowchart showing operations of the information processing device 4 and the acoustic apparatus (herein, the first acoustic apparatus 3A) in the position specifying processing of the information processing system 10. A user selects any of the first acoustic apparatus 3A, the second acoustic apparatus 3B, the third acoustic apparatus 3C, and the fourth acoustic apparatus 3D, which are shown in FIG. 7 (Step S41). More specifically, a section or a row of acoustic apparatuses, which is to be set by a user, is selected. The receiver 44 receives an input of the first acoustic apparatus 3A selected by a user, for example (Step S42). The outputter 43 of the information processing device 4 transmits through the AV receiver 2 the detection signal to the first acoustic apparatus 3A received by receiver (Step S43). The first acoustic apparatus 3A receives the detection signal (Step S44), and outputs a response signal (Step S45).

Herein, by using the response signal (e.g., beep sound), a user can specify a disposition place (disposition places A1 to A4) where the first acoustic apparatus 3A is disposed. In the information processing system 10 of the present embodiment, the first acoustic apparatus 3A is disposed on the left-hand side of the television 5. In other words, the first acoustic apparatus 3A is disposed on the front left-hand side of the user. The user, by operating an application on the screen, selects the disposition place A1 from a pulldown list, for example, such that a disposed position of the first acoustic apparatus 3A may be the disposition place A1 (Step S46). The receiver 44 of the information processing device 4 receives that the disposed position of the first acoustic apparatus 3A corresponds to the disposition place A1 (Step S47).

By the position specifying processor 45, the first acoustic apparatus 3A is associated with the disposition place A1 (Step S48). The storage 41 stores data in which the first acoustic apparatus 3A is associated with the disposition place A1 (Step S49).

In the information processing method of the present embodiment, a user can easily specify the acoustic apparatus outputting the beep sound, and can use the information processing device 4 to specify a disposed position of each acoustic apparatus. In other words, the information processing method of the present embodiment can easily specify a disposed position of the acoustic apparatus to be subjected to the estimation process, among the plurality of acoustic apparatuses 3A to 3F. As a result, the information processing method of the embodiment can specify a disposed position of an acoustic apparatus more simply.

Figure 11:
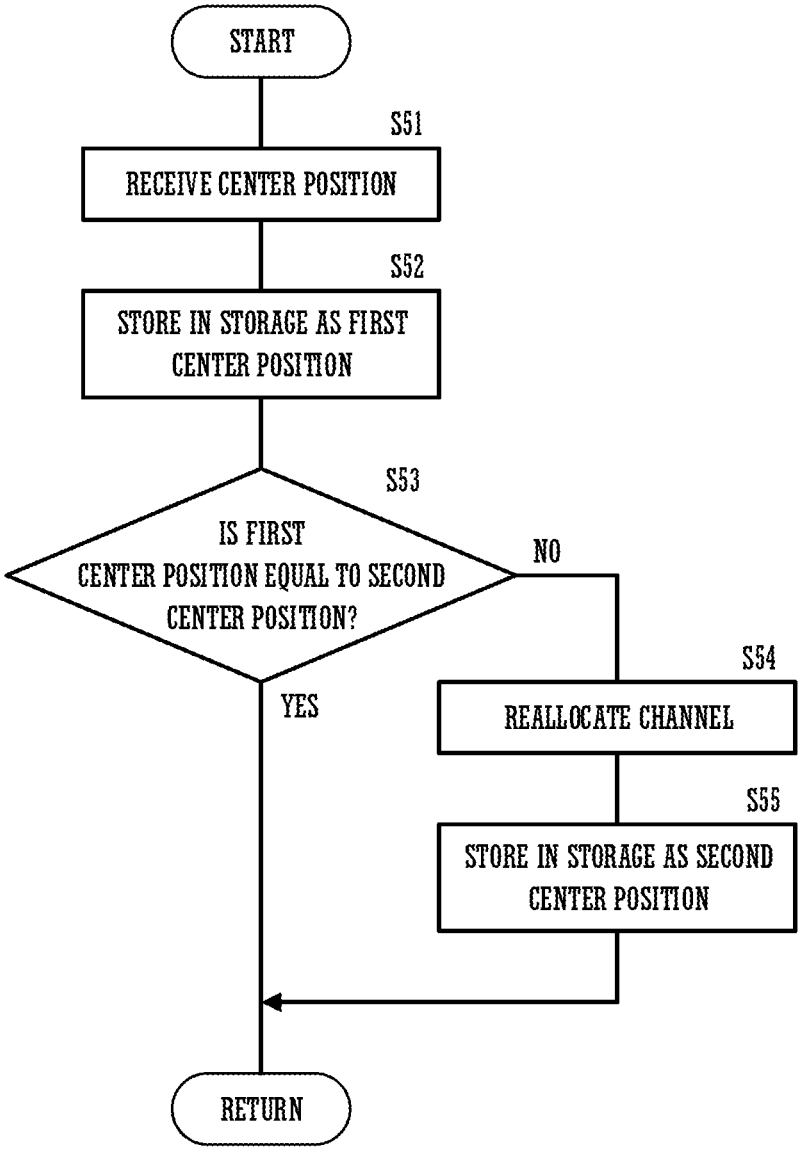
FIG. 11 is a flowchart showing an operation of the information processing device in channel allocation processing of the information processing system.

Channel setting processing will be described with reference to FIG. 11. FIG. 11 is a flowchart showing an operation of the information processing device 4 in the channel setting processing of the information processing system 10. As a precondition, the storage 41 stores a temporary center position (second center position) in advance.

The receiver 44 receives a center position selected by a user (Step S51). Note that, a position at which the television 5, shown in FIG. 2, is disposed is the center position. In the living room r1, as shown in FIG. 2, a television 5 side is defined as a front side, a wall side opposite to the front side where the television 5 is disposed is defined as a rear side and, both sides centered on the television 5 toward the front side are defined as a right-hand side and a left-hand side, respectively. The center position received by the receiver 44 is stored in the storage 41 as a first center position (Step S52). If the first center position and the second center position are different from each other (Step S53: No), the channel allocator 46, according to the first center position, allocates a channel to each of the first acoustic apparatus 3A, the second acoustic apparatus 3B, the third acoustic apparatus 3C, and the fourth acoustic apparatus 3D (Step S54). The channel allocator 46 causes the storage 41 to store the first center position as the second center position (Step S55).

In the information processing method of the present embodiment, by newly inputting the center position, channels of the acoustic apparatuses to be subjected to the estimation process, e.g., the first acoustic apparatus 3A, the second acoustic apparatus 3B, the third acoustic apparatus 3C, and the fourth acoustic apparatus 3D are reallocated. As a result, in the information processing method of the present embodiment, the information processing device 4 can set channels of the plurality of acoustic apparatuses, efficiently and suitably.

Note that the information processing device 4 may use an existing camera function to record a video or a photograph (an image) of the space, thereby analyzing the video data or the photograph to specify disposed positions of the plurality of acoustic apparatuses 3A to 3F.

Further, the response signal may be a sound. Thus, a user can detect the disposition place easily. In the information processing system 10 of the present embodiment, if the response signal is a sound, a user can specify acoustic apparatuses more easily.

What is claimed is:

1. An information processing device comprising:

an outputter configured to output a detection signal to a plurality of acoustic apparatuses at a same time;

a receiver configured to receive a disposed position of each of the plurality of acoustic apparatuses, based on a response signal outputted from the plurality of acoustic apparatuses that have received the detection signal at the same time;

a storage configured to store disposition data indicating specified disposed positions of the plurality of acoustic apparatuses, wherein the specified disposed positions are provided by a camera function configured to record an image of a space, in which the plurality of acoustic apparatuses is disposed, and analyze the image to specify the disposed position of each of the plurality of acoustic apparatuses; and a processor configured to allocate the disposed position received by the receiver to any one of the plurality of acoustic apparatuses included in the disposition data, and cause the storage to store the allocated disposed position to the disposition data.

2. The information processing device according to claim 1, wherein the receiver is configured to receive a center position, and the information processing device further comprises a channel allocator configured to allocate a channel to each of the plurality of acoustic apparatuses, in correspondence to the center position received by the receiver.

3. The information processing device according to claim 2, wherein the center position is stored in the storage, and in a case where a first center position that is a center position newly received by the receiver is different from a second center position that is a center position stored in the storage, the channel allocator is further configured to allocate the channel corresponding to the first center position to each of the plurality of acoustic apparatuses.

4. The information processing device according to claim 1, wherein the outputter is further configured to transmit an estimation signal that estimates the plurality of acoustic apparatuses located in a predetermined space, and output the detection signal to an acoustic apparatus of the plurality of acoustic apparatuses that has received the estimation signal.

5. The information processing device according to claim 1, further comprising a display that displays a layout drawing based on the disposition data, wherein the receiver is further configured to receive the disposed position by receiving an operation in which the layout drawing is used by a user.

6. An information processing system comprising:

the information processing device according to claim 1, wherein the plurality of acoustic apparatuses is configured to output the response signal in response to receiving the detection signal outputted from the information processing device.

7. The information processing system according to claim 6, wherein the response signal is a sound.

8. An information processing method comprising:

outputting a detection signal to a plurality of acoustic apparatuses at a same time;

receiving a disposed position of each of the plurality of acoustic apparatuses, based on a response signal outputted from the plurality of acoustic apparatuses that have received the detection signal at the same time;

storing disposition data indicating specified disposed positions of the plurality of acoustic apparatuses, wherein the specified disposed positions are provided by recording an image of a space, in which the plurality of acoustic apparatuses is disposed, and analyzing the image to specify the disposed position of each of the plurality of acoustic apparatuses;

allocating the received disposed position to any one of the plurality of acoustic apparatuses included in the disposition data stored in the storage; and causing the storage to store the allocated disposed position to the disposition data.

9. The information processing method according to claim 8, further comprising:

receiving a center position; and allocating a channel to each of the plurality of acoustic apparatuses, in correspondence to the received center position.

10. The information processing method according to claim 9, further comprising:

storing the center position in the storage; and in a case where a first center position that is a newly received center position is different from a second center position that is a center position stored in the storage, allocating the channel corresponding to the first center position to each of the plurality of acoustic apparatuses.

11. The information processing method according to claim 8, further comprising:

transmitting an estimation signal that estimates the plurality of acoustic apparatuses located in a desired space; and outputting the detection signal to an acoustic apparatus of the plurality of acoustic apparatuses that has received the estimation signal.

12. The information processing method according to claim 8, further comprising:

displaying a layout drawing on a display, the layout drawing being based on the disposition data; and receiving the disposed position by receiving an operation in which the layout drawing is used by a user.

* * * * *